US006863585B2

(12) United States Patent
Yang et al.

(10) Patent No.: US 6,863,585 B2
(45) Date of Patent: Mar. 8, 2005

(54) METHOD OF BONDING BY ANODIC BONDING FOR FIELD EMISSION DISPLAY

(75) Inventors: Shaue-An Yang, Taipei (TW); Cheng-Chung Lee, Hsinchu (TW); Ming-Chun Hsiao, Hsinchu (TW); Jung-Tang Huang, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 119 days.

(21) Appl. No.: 10/443,636

(22) Filed: May 22, 2003

(65) Prior Publication Data

US 2004/0029482 A1 Feb. 12, 2004

(30) Foreign Application Priority Data

Aug. 8, 2002 (TW) ..... 91117865 A

(51) Int. Cl.[7] ..... H01J 9/00; H01J 9/24

(52) U.S. Cl. ..... 445/24; 445/23; 445/25; 219/602; 219/603; 29/603.11

(58) Field of Search ..... 445/24, 23, 25, 445/50, 51; 313/292, 495, 496, 497; 219/602, 603, 615, 616; 29/603.11

(56) References Cited

U.S. PATENT DOCUMENTS 6,429,582 B1 * 8/2002 Watkins et al. ..... 313/495
6,722,936 B2 * 4/2004 Hammel ..... 445/24

* cited by examiner

*Primary Examiner*—Joseph Williams
*Assistant Examiner*—Anthony J Canning
(74) *Attorney, Agent, or Firm*—Quintero Law Office

(57) ABSTRACT

A method of bonding spacers to an anode plate of a field emission display. An anode plate having separate phosphor regions is provided, wherein a black matrix material is provided to separate the phosphor regions from one another. A magnetic layer is formed on the black matrix material. A thin metal film is formed on the anode plate and the magnetic layer. Spacers are disposed on the metal film above the black matrix material. An electromagnetic induction procedure is performed to heat the magnetic layer and thus serves as a heating source to produce heat, wherein the heat goes through the metal film to heat the spacers. A direct current (D.C.) electric field procedure is performed to bond the spacers to the metal film above the black matrix material.

20 Claims, 3 Drawing Sheets

METHOD OF BONDING BY ANODIC BONDING FOR FIELD EMISSION DISPLAY

BACKGROUND OF THE INVENTION

1. Field of the Invention

The present invention relates to a field emission display (FED) process, and more particularly, to a method of bonding spacers to an anode plate of the FED.

2. Description of the Related Art

Recently, since field emission display (FED) devices have the advantages of spontaneous high-brightness, lightweight, thin, and power efficient characteristics, FED technology has received increased industry attention. Flat panel displays utilizing FED technology employ a matrix-addressable array of cold, pointed field emission cathodes in combination with a luminescent phosphor screen.

It is known in the art to make spacers for use in field emission displays for the purpose of maintaining the separation between the cathode and the anode plates. Conventionally, an anodic bonding technology is used to bond the spacers to the anode plate.

FIG. 1 is a sectional view illustrating the conventional anodic bonding process of a field emission display. Numeral 100 indicates a heating plate. Numeral 110 indicates a glass plate. A transparent electrode 112 is formed on the glass plate 110. Phosphor regions 114 are separately formed on the transparent electrode 112, wherein a black matrix material 116 is provided to separate the phosphor regions 114 from one another. An aluminum film 118 is formed on the phosphor regions 116 and the black matrix material 116.

In FIG. 1, the whole glass plate 110 is put on the heating plate 100 to attain the bonding temperature of above 300° C. Thus, the spacers 120 connected to a conductive plate 130 can be bonded to the aluminum film 118 above the black matrix material 116 by the anodic bonding method, wherein the conductive plate 130 and the aluminum film 118 are electrically connected to a D.C. power supply.

Nevertheless, because of the higher bonding temperature process (above 300° C.), thermal stress occurs in the glass plate 110, thereby deforming the glass plate 110 and affecting other devices thereon. Also, the entire glass plate 110 requires heating, so the conventional method is relatively power hungry and inefficient. Additionally, coordination of the size of the heating plate 100 and the glass plate 110, cause great inconvenience in field emission display fabrication.

SUMMARY OF THE INVENTION

The object of the present invention is to provide a method of forming a FED device.

Another object of the present invention is to provide a method of bonding spacers to an anode plate of a FED.

In order to achieve these objects, the present invention provides a method of bonding spacers to an anode plate of a FED. An anode plate having separate phosphor regions is provided, wherein a black matrix material is provided to separate the phosphor regions from one another. A magnetic layer is formed on the black matrix material. A thin metal film is formed on the anode plate and the magnetic layer. Spacers are disposed on the metal film above the black matrix material. An electromagnetic induction procedure is performed to heat the magnetic layer and thus serves as a heating source to produce heat, wherein the heat goes through the metal film to heat the spacers. A direct current (D.C.) electric field procedure is performed to bond the spacers to the metal film above the black matrix material.

The present invention improves on the prior art in that the spacers are heated by means of heat generated from the magnetic layer as it is heated by the electromagnetic induction procedure. Thus, the local heating mechanism of the invention can decrease thermal stress in the anode plate, thereby raising reliability and yield, and ameliorating the disadvantages of the prior art.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

An embodiment of the invention is for a method of bonding spacers to an anode plate of a field emission display (FED). FIGS. 2~5 are sectional views illustrating the bonding process according to the present invention.

Figure 1:
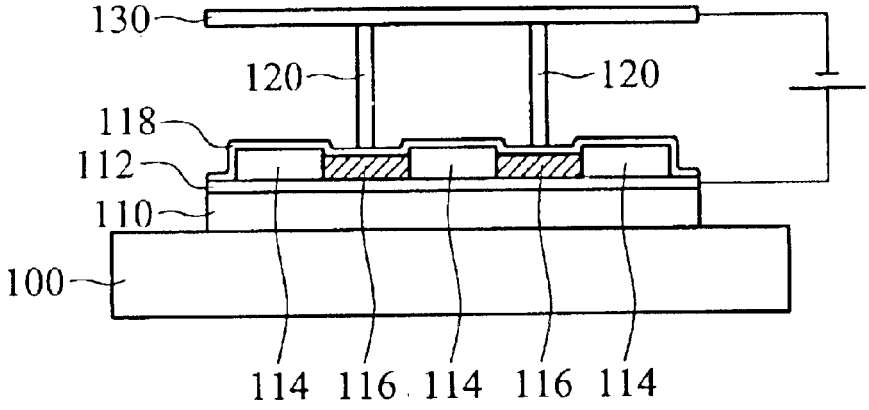
FIG. 1 (PRIOR ART)
FIG. 1 is a schematic view showing the bonding process of the prior art.
Figure 2:
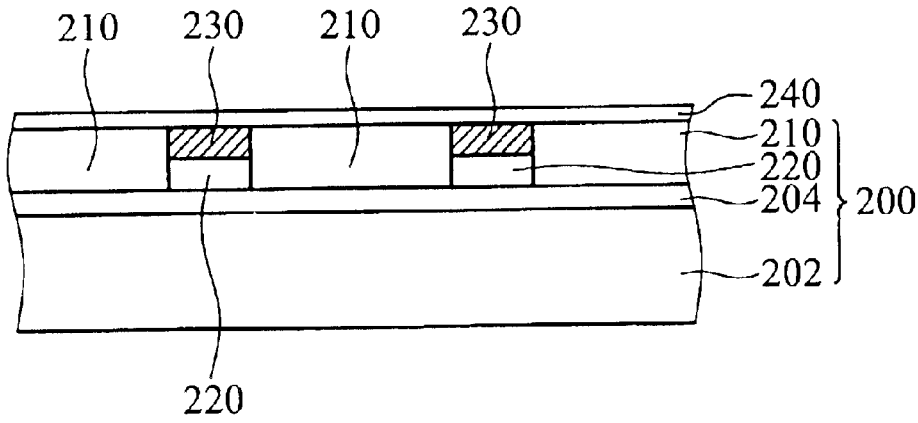
FIGS. 2~5 are sectional views illustrating the bonding process according to the present invention.

In FIG. 2, an anode plate 200 of a FED is provided. The anode plate 200 has a plurality of separate phosphor regions 210, wherein a black matrix material 220 is provided to separate the phosphor regions 210 from one another. The method of forming the anode plate 200 includes the following steps. A transparent electrode 204, such as an indium tin oxide (ITO) layer, is formed on a glass plate 202. The phosphor regions 210 and the black matrix material 220 are formed on the transparent electrode 204. The black matrix material 220 remains between the phosphor regions 210. Generally, a constant distance with the black matrix material 220 separates the phosphor regions 210.

In FIG. 2, a magnetic layer 230 is formed on the black matrix material 220 by, for example, deposition or sputtering. The magnetic layer 230 includes a magnetic material, such as iron (Fe), cobalt (Co) and/or nickel (Ni).

In FIG. 2, a thin metal film 240 such as an aluminum (Al) film is formed on the anode plate 200 and the magnetic layer 230 by, for example, deposition or sputtering. The thickness of the thin metal film 240 is preferably 800~2000 angstroms.

Figure 3:
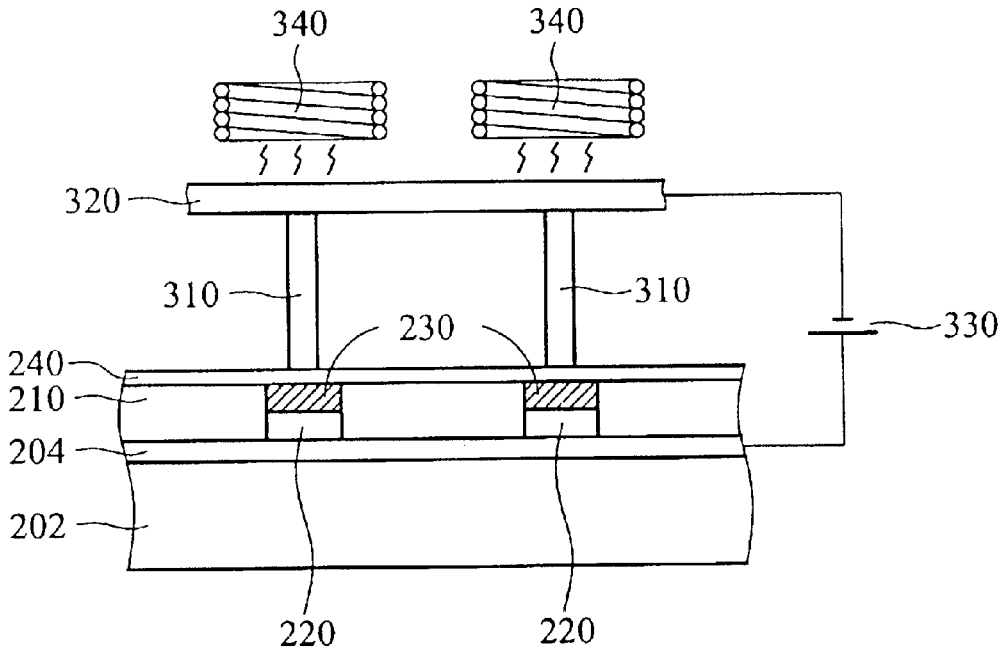

In FIG. 3, spacers 310 are disposed on the metal film 240 above the black matrix material 220. The material of the spacers 310 is glass. A spacer alignment machine can be utilized for disposing the spacers 310.

In FIG. 3, a conductive plate 320, such as an ITO plate, connects the spacers 310. Then, a direct current (D.C.) power supply 330 is provided, wherein the negative (−) electrode of the D.C. power supply connects the conductive plate 320, and the positive (+) electrode connects the transparent electrode 204 of the anode plate 200. The D.C. power supply 330 is to provide a D.C. voltage differential (about 100~1000 volt.) between the conductive plate 320 and the anode plate 200. That is, a D.C. electric field procedure is performed between the conductive plate 320 and the anode plate 200.

In FIG. 3, an electromagnetic induction procedure is performed to heat only the magnetic layer 230 to above 300°

C. Thus, the magnetic layer 230 heated with electromagnetic induction serves as a heating source to produce heat. The heat goes through the metal film 240 to heat the spacers 310. It should be noted that the electromagnetic induction procedure is a local heating mechanism, thereby decreasing thermal stress in the glass plate 202. Also, according to the electromagnetic induction procedure, the anode plate 200 does not need to make contact with the electromagnetic induction equipment (340). Thus, the size improvement of the FED is not limited.

As a demonstrative example, the electromagnetic induction procedure is to use at least one induction coil 340 to produce a high frequency to rapidly heat the surface of the magnetic layer 230. In this embodiment, the present method utilizes the local heating mechanism to heat the spacers 310. When the temperature of the spacers 310 is above 300° C. (about 300~500° C.), metal ions ($M^+$ ions) in the spacers 310, such as $Na^+$ ions, are released and bond with the metal film 240.

Figure 4:
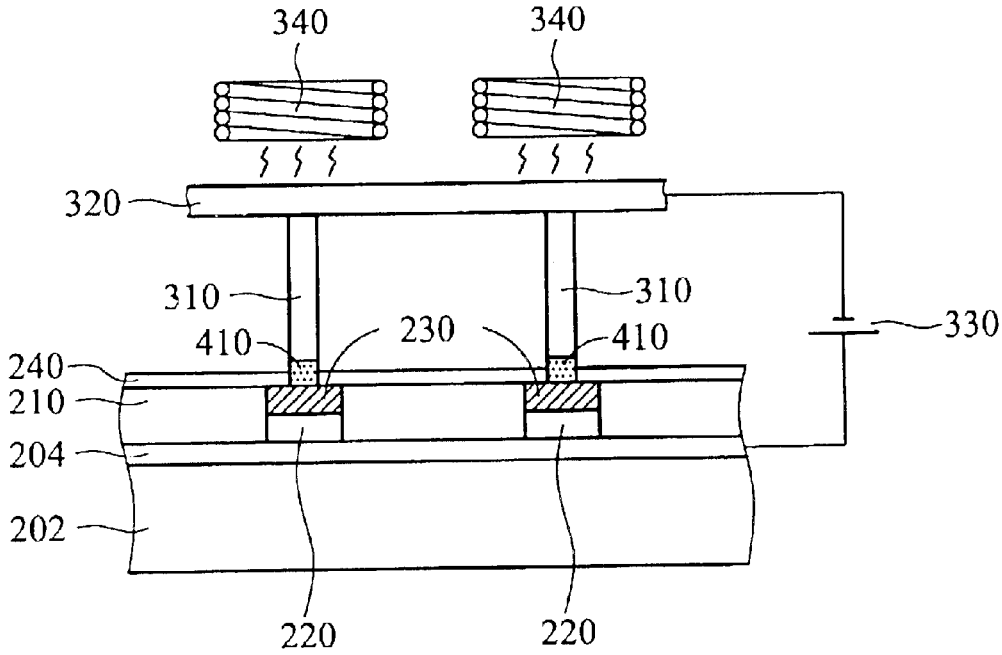
Figure 5:
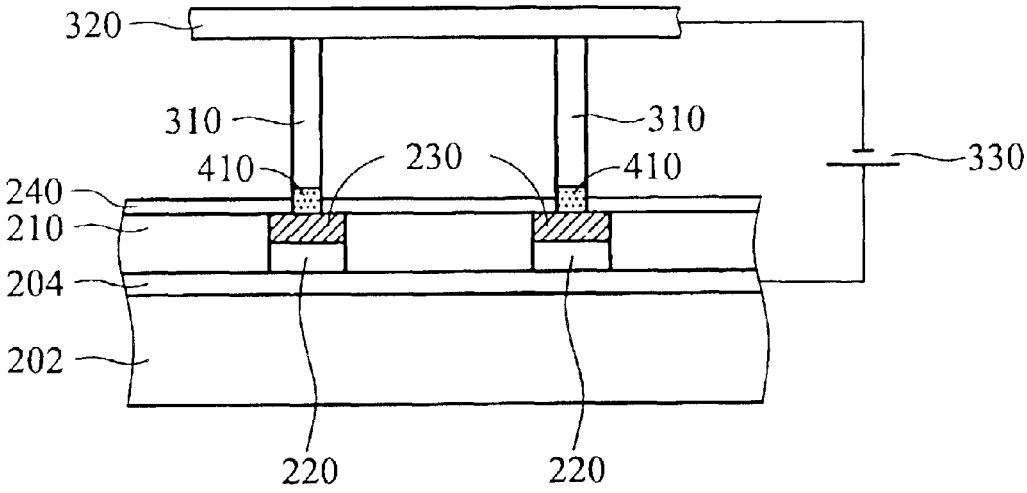

In FIG. 4, since the spacers 310 are heated, the $M^+$ ions and oxygen ions ($O^{2-}$ ions) in the spacers 310 are released. Also, the D.C. electric field procedure is performed between the spacers 310 and the anode plate 200, wherein the $M^+$ ions move toward the conductive plate 320 and the $O^{2-}$ ions move toward to the metal film 240. An oxidation reaction between the $O^{2-}$ ions and the metal film 240 occurs to form a metal oxide layer 410, such as an $Al_2O_3$ layer, thereby bonding the spacers 310 to the metal film 240. Thus, the spacers 310 are firmly fixed to the metal film 240 by means of the metal oxide layer 410, as shown as FIG. 5.

Next, the conductive plate 320 and the D.C. power supply 330 are removed.

Figure 6:
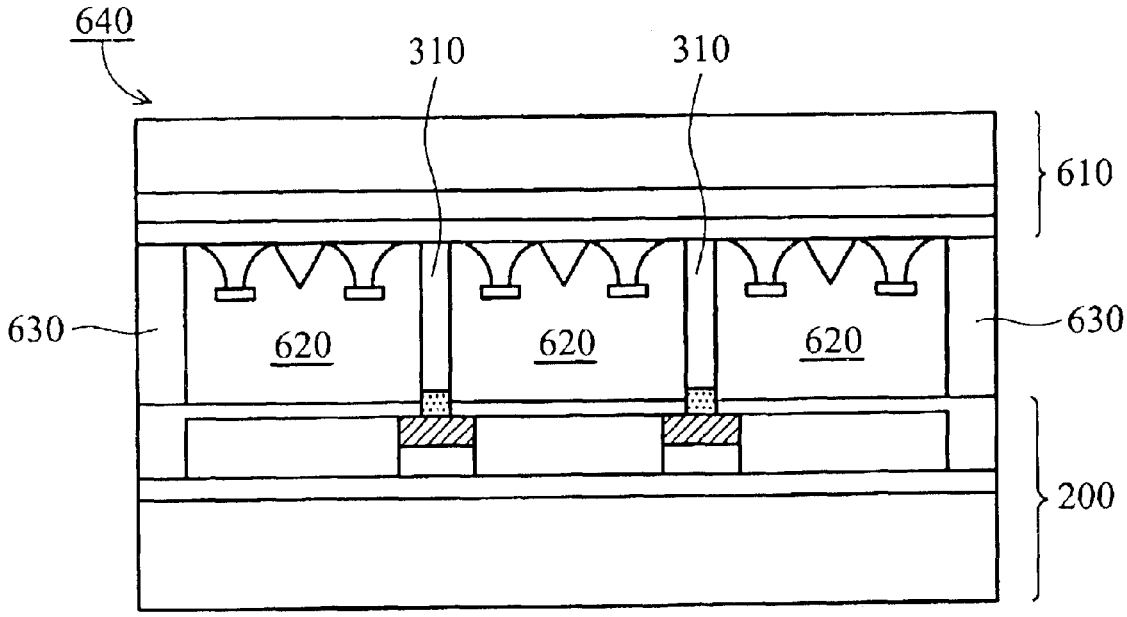
FIG. 6 is a sectional view of a field emission display realized by performing various steps of the present method.

Moreover, referring to FIG. 6, a FED device 640 is shown. A cathode plate 610 is faced to the anode plate 200, and the spacers 310 are disposed between the anode plate 200 and the cathode plate 610. Then, a frame 630 is formed to seal the surrounding area of the FED device 640. An evacuated region 620 exists between the anode plate 200 and the cathode plate 610. The pressure attained within the evacuated region 620 is less than $10^{-6}$ torr by performing a vacuum processing.

Thus, the present invention provides a method of bonding spacers to an anode plate with an electromagnetic induction procedure and a D.C. electric field procedure. The spacers are heated by means of heat generated from the magnetic layer as it is heated by the electromagnetic induction procedure. Thus, the local heating mechanism of the invention can decrease thermal stress in the anode plate, there by raising reliability and yield. Also, the local heating mechanism of the invention can rapidly heat the magnetic layer to heat the spacers, thereby increasing throughput and achieving power efficiency. Additionally, use of the electromagnetic induction procedure in the invention eliminates concerns regarding the coordination of the size of the FED device and the heating equipment, thereby simplifying the fabrication process.

Finally, while the invention has been described by way of example and in terms of the above, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of bonding spacers to an anode plate of a field emission display, comprising the steps of:

providing an anode plate having separate phosphor regions, wherein a black matrix material is provided to separate the phosphor regions from one another;

forming a magnetic layer on the black matrix material;

forming a metal film on the anode plate and the magnetic layer;

disposing spacers on the metal film above the black matrix material;

performing an electromagnetic induction procedure to heat the magnetic layer, thus serving as a heating source to produce heat, wherein the heat goes through the metal film to heat the spacers; and performing a direct current (D.C.) electric field procedure to bond the spacers to the metal film above the black matrix material.

2. The method according to claim 1, wherein the formation of the anode plate comprises the steps of:

providing a glass plate;

forming a transparent electrode on the glass plate; and forming the phosphor regions and the black matrix material on the transparent electrode.

3. The method according to claim 1, wherein the magnetic layer comprises iron (Fe), cobalt (Co) and/or nickel (Ni).

4. The method according to claim 1, wherein the metal film comprises aluminum (Al).

5. The method according to claim 1, wherein the spacer comprises glass.

6. The method according to claim 1, wherein the electromagnetic induction procedure is to use at least one induction coil to produce high frequency to heat the magnetic layer.

7. The method according to claim 1, wherein the magnetic layer is heated to above 300° C.

8. The method according to claim 1, wherein the D.C. electric field procedure is to provide a D.C. voltage differential between the spacers and the anode plate.

9. The method according to claim 8, wherein the D.C. voltage differential is 100~1000 volt.

10. The method according to claim 2, wherein the direct current (D.C.) electric field procedure comprises the steps of:

providing a conductive plate connected to the spacers; and providing a D.C. power supply;

wherein the negative electrode of the D.C. power supply connects the conductive plate, and the positive electrode connects the transparent electrode of the anode plate.

11. A method of bonding spacers to an anode plate of a field emission display, comprising the steps of:

providing an anode plate having separate phosphor regions, wherein a black matrix material is provided to separate the phosphor regions from one another;

forming a magnetic layer on the black matrix material;

forming an aluminum (Al) film having a thickness of 800~2000 angstroms on the anode plate and the magnetic layer;

disposing glass spacers on the Al film above the black matrix material;

performing an electromagnetic induction procedure to heat the magnetic layer, thus serving as a heating source to produce heat, wherein the heat goes through the Al film to heat the glass spacers; and performing a direct current (D.C.) electric field procedure to bond the glass spacers to the Al film above the black matrix material.

12. The method according to claim 11, wherein the formation of the anode plate comprises the steps of:

providing a glass plate;

forming a transparent electrode on the glass plate; and forming the phosphor regions and the black matrix material on the transparent electrode.

13. The method according to claim 11, wherein the magnetic layer comprises iron (Fe), cobalt (Co) and/or nickel (Ni).

14. The method according to claim 11, wherein the electromagnetic induction procedure is to use at least one induction coil to produce high frequency to heat the magnetic layer.

15. The method according to claim 11, wherein the magnetic layer is heated to above 300° C.

16. The method according to claim 11, wherein the D.C. electric field procedure is to provide a D.C. voltage differential between the glass spacers and the anode plate.

17. The method according to claim 16, wherein the D.C. voltage differential is 100~1000 volt.

18. The method according to claim 12, wherein the direct current (D.C.) electric field procedure comprises the steps of:

providing a conductive plate connected to the glass spacers; and providing a D.C. power supply;

wherein the negative electrode of the D.C. power supply connects the conductive plate, and the positive electrode connects the transparent electrode of the anode plate.

19. The method according to claim 12, wherein the transparent electrode comprises indium tin oxide (ITO).

20. The method according to claim 18, wherein the conductive plate comprises indium tin oxide (ITO).

* * * * *